US006347426B1

(12) United States Patent
Weiss

(10) Patent No.: US 6,347,426 B1
(45) Date of Patent: Feb. 19, 2002

(54) PAINT ROLLER RETAINER

(76) Inventor: Sherman L. Weiss, 11360 Sherman Way, Sun Valley, CA (US) 91352-4944

( * ) Notice: Subject to any disclaimer, the term of this patent is extended or adjusted under 35 U.S.C. 154(b) by 0 days.

(21) Appl. No.: 09/522,864

(22) Filed: Mar. 9, 2000

(51) Int. Cl.[7] ..... B05C 1/08
(52) U.S. Cl. ..... 15/230.11; 492/13; 492/19
(58) Field of Search ..... 15/230.11; 492/13, 492/14, 16–19

(56) References Cited

U.S. PATENT DOCUMENTS

| | | | |
|---|---|---|---|
| 756,695 | A | 4/1904 | Peterson |
| 922,148 | A | 5/1909 | Kariya |
| 2,225,517 | A | 12/1940 | Barker |
| 2,520,863 | A | 8/1950 | Thomas et al. |
| 2,749,599 | A | 6/1956 | Kreger |
| 2,758,364 | A | 8/1956 | McMillan |
| 2,766,473 | A | 10/1956 | Thackara |
| 2,887,711 | A | 5/1959 | Hutchinson |
| 2,891,301 | A | 6/1959 | Conklin |
| 2,907,061 | A | 10/1959 | Whalen |
| 2,913,752 | A | * 11/1959 | Boyles |
| 2,951,256 | A | 9/1960 | Hulsh |
| 2,977,671 | A | 4/1961 | Wiegand |
| 2,982,010 | A | 5/1961 | Johns |
| 2,982,981 | A | 5/1961 | Waara |
| 3,085,270 | A | 4/1963 | Vosbikian et al. |
| 3,115,659 | A | 12/1963 | Church |
| 3,119,137 | A | 1/1964 | Schueler |
| 3,201,815 | A | 8/1965 | Selby |
| 3,274,637 | A | 9/1966 | Schulze |
| 3,346,899 | A | 10/1967 | Murphy |
| 3,378,872 | A | 4/1968 | Frontera et al. |
| D212,131 | S | 8/1968 | Sakow |
| 3,418,673 | A | 12/1968 | Kruth |
| 3,421,822 | A | 1/1969 | Roche |
| 3,942,209 | A | 3/1976 | Walls |
| 4,467,509 | A | 8/1984 | Dezen |
| 4,528,712 | A | 7/1985 | Leibow |
| 4,829,623 | A | 5/1989 | Brezette et al. |
| D305,080 | S | 12/1989 | Morgan et al. |
| 4,897,893 | A | 2/1990 | Barker |
| 4,985,958 | A | 1/1991 | Garcia |
| 5,014,384 | A | 5/1991 | Brezette et al. |
| 5,167,055 | A | 12/1992 | Stoddart et al. |
| D334,476 | S | 4/1993 | Niemacki |
| D340,357 | S | 10/1993 | Krinke |
| 5,497,527 | A | 3/1996 | Jang et al. |
| 5,551,323 | A | 9/1996 | Beere et al. |
| 5,594,971 | A | 1/1997 | Nelson |
| 5,613,264 | A | 3/1997 | Knowles |
| 5,755,004 | A | 5/1998 | Miller |
| 5,769,769 | A | 6/1998 | Torntore |
| 5,795,279 | A | 8/1998 | Shieh |
| 5,806,129 | A | 9/1998 | Nelson |
| 5,857,241 | A | 1/1999 | Camp, Jr. et al. |
| 5,870,795 | A | 2/1999 | Sizemore |

FOREIGN PATENT DOCUMENTS

| | | |
|---|---|---|
| GB | 887294 | 1/1962 |
| GB | 954819 | 4/1964 |

* cited by examiner

*Primary Examiner*—Terrence R. Till
(74) *Attorney, Agent, or Firm*—Marshall A. Lerner, Esq.; Bradford E. Mattes, Esq.; Kleinberg & Lerner, Esq.

(57) ABSTRACT

A paint roller incorporates a free end cap capable of receiving a retainer that prevents the paint roller's cylindrical brush from sliding over the free end cap when painting.

2 Claims, 2 Drawing Sheets

PAINT ROLLER RETAINER

BACKGROUND

This invention is a paint roller applicator for retaining a paint roller brush on a paint roller cage.

A typical paint roller, as contemplated for use in combination with the instant invention, comprises a handle, a rigid shaft extending from the handle, a cage rotatably attached to the rigid shaft, the cage further having a handle end and a free end, a cylindrical shaped handle end cap affixed to the end of the cage where the shaft enters the cage from the handle, and a cylindrical shaped free end cap affixed to the other end of the cage where the shaft terminates. A cylindrical paintbrush (also known as a "cover" or "brush") is affixed to and surrounds the cage and part of each end cap in such a manner that the brush, end caps, and cage rotate together. In the normal course of operation, a user grasps the handle and dips the brush in a paint container so that its outer surface absorbs paint. The user then grasps the handle to manually apply the outer surface of the brush to the surface to be painted by rolling it against the surface.

The brush in a typical paint roller is affixed to the cage and end caps by means of a press fit or interference fit. To be practical, this fit between the cage and cylindrical brush must be loose enough to enable the brush to be slipped over the cage and end caps by hand. In achieving that looseness, however, the brush is at risk of sliding off the cage during use. The present invention overcomes this problem by adding a positive stop feature as described herein to the free end cap to prevent the cover from sliding during use.

No known prior art paint rollers incorporate any such positive stop feature.

U.S. Pat. Nos. 3,115,659 to Church; 3,274,637 to Schulze; 5,014,384 to Brezette et al., and United Kingdom patent, no. 887,294 to Ashley all disclose a paint roller wherein the brush resides in a single-piece housing. In each of those patents, the housing, among other things, acts as a barrier to keep the cover from sliding off the roller. Although the housings shown in those prior art patents prevent their respective roller paint brushes from sliding completely off of the cage, they do not disclose any means or structure, as is the case in the present invention, to prevent the brush from sliding into and thereby rubbing against the housing during use. Additionally, because all of these housings are attached at both ends of the cage, these inventions do not permit ready removal and replacement of roller covers.

The paint rollers disclosed in U.S. Pat. Nos. 3,378,872 to Frontera et al.; 3,085,270 to Vosbikian et al.; 4,528,712 to Leibow; and 4,985,958 to Garcia do not disclose any means for ready removal and replacement of the brush. Nor do any of those patents disclose any positive stop feature for retaining the brush.

The paint rollers disclosed in U.S. Pat. Nos. 5,594,971 to Nelson and 5,806,129 to Nelson require the user to perform at least two operations simultaneously in order to remove or install a brush.

In light of the foregoing shortcomings in the prior art, a paint roller is needed that will allow the user to easily remove and replace the roller brush without leaving the brush at risk of sliding with respect to the cage when painting.

SUMMARY

The present invention provides a paint roller retainer which prevents the paint roller's cylindrical brush from sliding over the end cap when painting. This is achieved by providing a free end cap having a removable roller retainer having a diameter greater than the diameter of the free end cap. The greater diameter of the removable roller retainer in comparison with the diameter of the end cap provides a positive stop feature to the free end cap.

A cylindrical paint brush is installed or removed by removing the roller retainer so that it is not in a position to prevent installation or removal of the cylindrical paint brush. To keep the cylindrical paint brush from sliding with respect to the cage during painting operations, the roller retainer is re-attached to the free end cap.

A preferred version of the paint roller applicator of the present invention includes a handle, a rigid shift, and further includes:

(a) a roller cage mounted on the rigid shaft and having a handle end and a free end;

(b) an end cap affixed to the handle end of the roller cage (hereinafter the "handle end cap"), the handle end cap further having a cylindrical surface and a circular flat surface, (c) an end cap affixed to the free end of the roller cage (hereinafter the "free end cap"), the free end cap further having a cylindrical outer surface and a threaded inner surface;

(d) a roller retainer comprising a threaded portion for receipt by the threaded inner surface of the free end cap and a retainer disk having a diameter larger than the diameter of the cylindrical outer surface of the free end cap and further having means for accommodating a rotational force; and (e) a roller brush.

DRAWINGS

These and other features and advantages of the present invention will be better understood by referring to the following description, claims, and accompanying drawings in which:

DESCRIPTION

Figure 1:
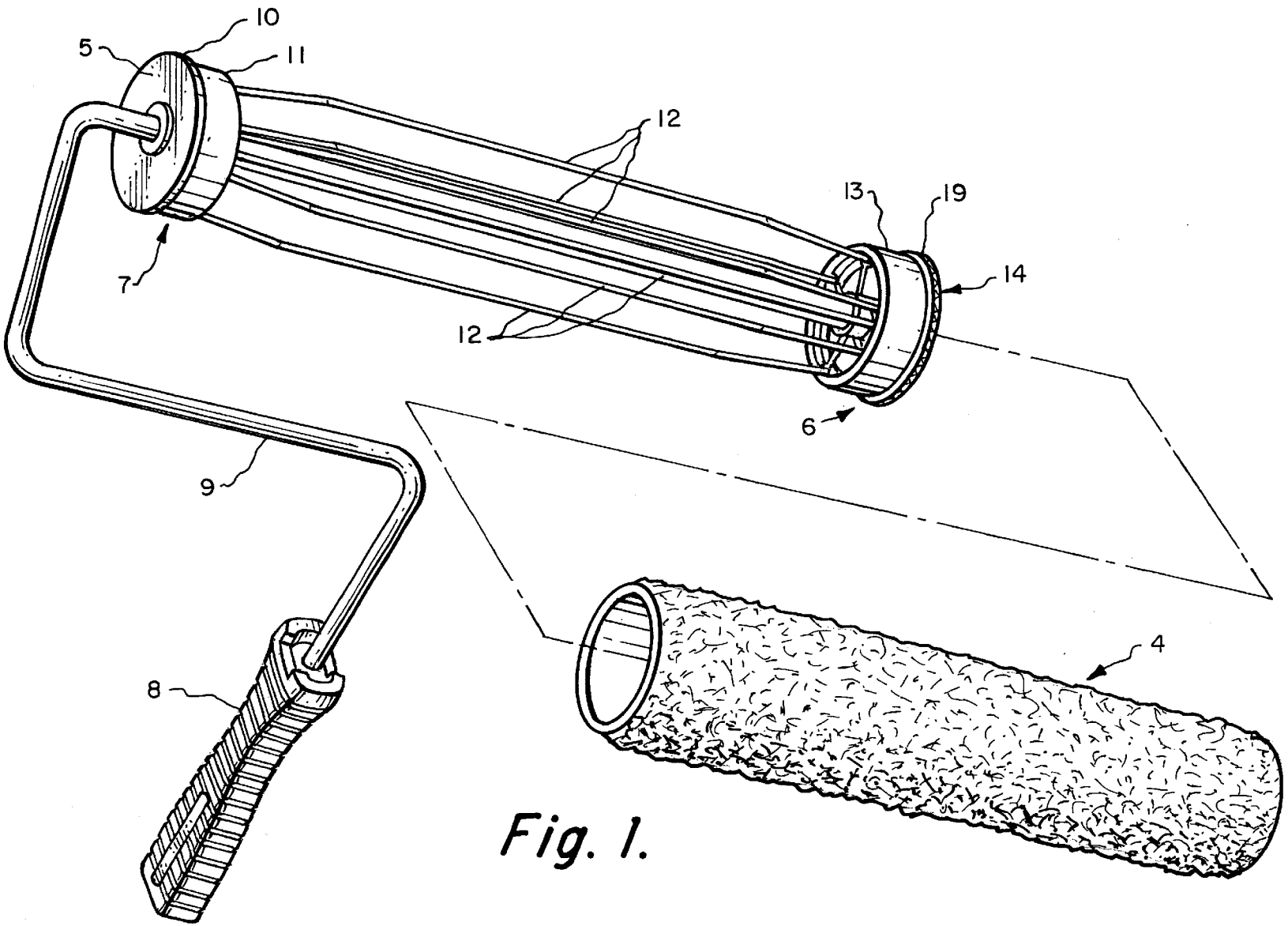
FIG. 1 is a perspective view of a paint roller applicator.
Figure 2:
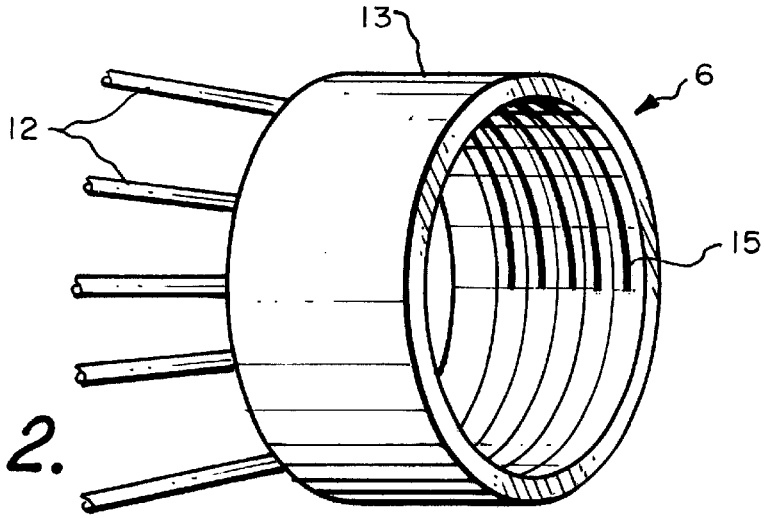
FIG. 2 is an enlarged perspective view of the free end cap shown in FIG. 1.

As shown in FIG. 1, a paint roller comprises a handle 8 to which is attached a shaft 9. A roller cage 12 having a handle end cap 7 and a free end cap 6 is rotatably mounted on the shaft 9 so that the handle end cap 7 is closer to the handle 8 than the free end cap 6 when measured along the shaft 9. The cage 12 is held together by the handle end cap 7 and the free end cap 6 which each rotate about the shaft 9.

The handle end cap 7 comprises a cylindrical surface 11 for receiving the roller brush 4 and a flat surface 5 that extends concentrically beyond the cylindrical surface 11 to form a lip 10 that acts as a positive stop to prevent the roller brush 4 from sliding completely over the handle end cap 7.

The free end cap 6 comprises a cylindrical outer surface 13 and a threaded inner surface 15 that permits ready removal or installation of a roller retainer 14 so that a roller brush 4 may be removed or installed by sliding it over the cylindrical surface 13.

Figure 3:
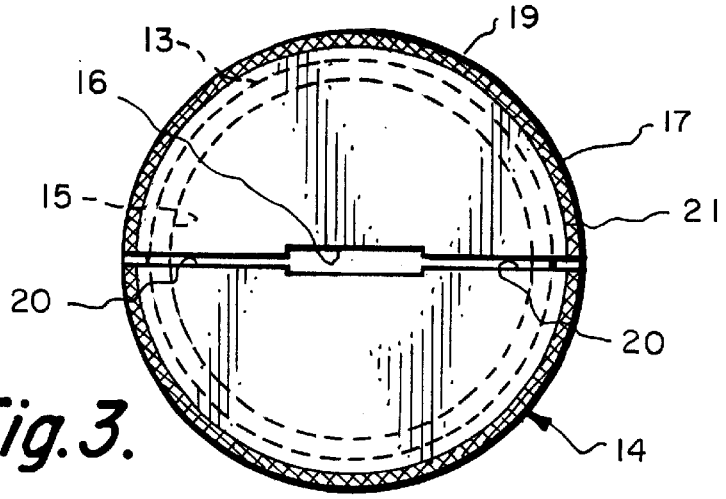
FIG. 3 is an enlarged side view of the roller retainer shown in FIG. 1.
Figure 4:
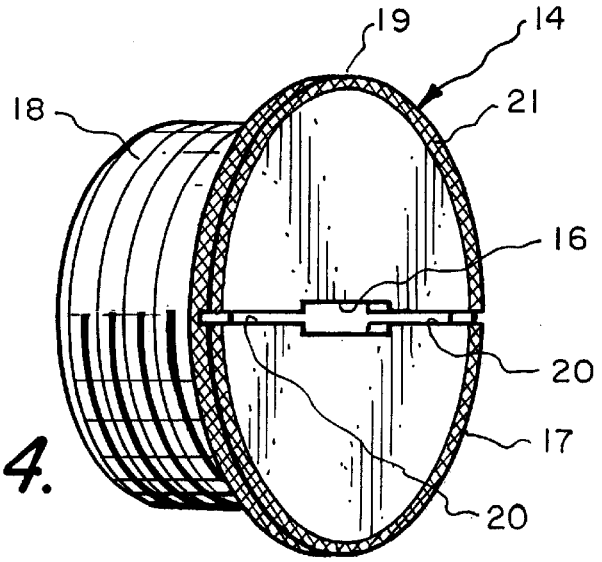
FIG. 4 is an enlarged perspective view of the roller retainer shown in FIG. 1.

As shown in FIGS. 3 and 4, the roller retainer 14 further comprises a retainer disk 17, a threaded portion 18, and means for the retainer disk 17 to receive a rotational force. In a preferred embodiment, the retainer disk 17 embodies means to receive a rotational force via a slot 16, an extended slot 20, and a knurled surface 21.

The retainer disk 17 has a diameter larger than the diameter of the free end cap 6. When the roller retainer 14 is installed on the free end cap 6, this larger diameter creates a lip 19 that retains the roller brush 4 on the roller cage 12.

To remove or install a roller brush 4 on a paint roller embodying the roller retainer 14 described herein, the user unscrews the roller retainer 14 by inserting a coin, screwdriver, putty knife, or other suitable object into slot 16 or extended slot 20 and applying a rotational force. The roller retainer 14 may also be removed or installed by applying a rotational force to the knurled surface 21 by hand. Removal of the roller retainer 14 effectively removes the lip 19 and permits the roller brush 4 to be removed or installed.

The present invention described above has many advantages. The ability to lock the roller brush into place and thereby prevent it from sliding while being used will eliminate mishaps that would otherwise result. The ability of the roller retainer to be held in a fixed position while the roller brush rotates ensures that the roller brush will remain in place throughout rolling operations.

Although the present invention has been described in detail and refers to a certain preferred version, other versions are possible. Accordingly, the spirit and scope of the following claims should not be limited to the description of the version referenced herein.

What is claimed is:

1. A paint roller applicator having a handle, a rigid shaft extending from said handle and a cage rotatably attached to said rigid shaft, said cage having a handle end and a free end, said free end comprising:

(a) a free end cap mounted at the free end of said cage and having means to receive a roller retainer; and (b) a roller retainer having a diameter greater than the diameter of the free end cap and further having a slot combined with an extended slot to permit application of a rotational force to said free end cap to allow ready removal or installation of the free end cap thereby enabling a paint roller brush to be readily removed from or installed on said cage.

2. A paint roller applicator having a handle, a rigid shaft extending from said handle and a cage rotatably attached to said rigid shaft, said cage having a handle end and a free end, said free end comprising:

(a) a free end cap mounted at the free end of said cage and having means to receive a roller retainer; and (b) a roller retainer having a diameter greater than the diameter of the free end cap and further having a slot combined with an extended slot and a knurled surface to permit application of a rotational force to said free end cap to allow ready removal or installation of the free end cap thereby enabling a paint roller brush to be readily removed from or installed on said cage.

* * * * *